US007040848B2

(12) United States Patent
Sain

(10) Patent No.: US 7,040,848 B2
(45) Date of Patent: May 9, 2006

(54) TRANSPORT PLATFORM

(75) Inventor: Bernard S. Sain, Jacksonville, FL (US)

(73) Assignee: ITL Technologies, Inc., Jacksonville, FL (US)

( * ) Notice: Subject to any disclaimer, the term of this patent is extended or adjusted under 35 U.S.C. 154(b) by 0 days.

(21) Appl. No.: 10/820,016

(22) Filed: Apr. 8, 2004

(65) Prior Publication Data

US 2005/0019128 A1 Jan. 27, 2005

Related U.S. Application Data

(63) Continuation-in-part of application No. 10/622,536, filed on Jul. 21, 2003.

(51) Int. Cl.
*B60P 1/64* (2006.01)
*B63B 25/22* (2006.01)

(52) U.S. Cl. ..... 410/46; 410/77

(58) Field of Classification Search ..... 410/46, 410/31, 32, 35, 52, 71, 72, 73, 77; 144/256, 144/116

See application file for complete search history.

(56) References Cited

U.S. PATENT DOCUMENTS 3,386,600 A * 6/1968 Betjemann ..... 294/68.1
3,459,326 A * 8/1969 Betjemann ..... 220/1.5
3,537,414 A * 11/1970 Goldman ..... 410/89
3,583,350 A * 6/1971 Goldman ..... 114/72
3,665,869 A * 5/1972 Howe ..... 108/53.1
3,735,713 A * 5/1973 Glassmeyer ..... 108/53.5
3,807,582 A * 4/1974 Anderson ..... 414/141.3
3,836,026 A * 9/1974 Peterson ..... 414/802
4,068,813 A 1/1978 Chatwin et al.
4,131,071 A * 12/1978 Glassmeyer ..... 108/53.1
4,151,925 A * 5/1979 Glassmeyer ..... 220/1.5
4,162,737 A * 7/1979 Clive-Smith ..... 220/1.5
4,530,628 A * 7/1985 Igielska ..... 410/40
4,638,744 A 1/1987 Clive-Smith
4,986,705 A 1/1991 Durkin
5,215,026 A * 6/1993 Windelberg et al. ..... 114/72
5,403,055 A * 4/1995 Allison ..... 294/67.1
5,439,152 A * 8/1995 Campbell ..... 224/405
5,494,182 A 2/1996 Clive-Smith
5,562,062 A * 10/1996 Upmeyer ..... 114/72
5,639,174 A * 6/1997 Gonska ..... 403/103
5,644,992 A 7/1997 Clive-Smith (Continued)

OTHER PUBLICATIONS

"ISO Containers Collapsible Flat Rack 20", http://www.cobracontainers.com/isocfr20_02.htm, dated Dec. 17, 2003.

(Continued)

*Primary Examiner*—H. Gutman
(74) *Attorney, Agent, or Firm*—Foley & Lardner LLP

(57) ABSTRACT

An embodiment of a transport platform has a platform having first and second end members in which spaced vertically extending first slots are formed, the first slots being adapted to receive one of a plurality of vertically extending guide members that are provided on bulkheads of a container ship hold. The transport platform also has first and second sets of vertically extending pillars which are respectively provided at first and second ends of the platform. First and second cross members respectively interconnect the upper ends of the first and second set of pillars. The first and second cross members each having spaced vertically extending second slots that are aligned with the vertically extending first slots and which are adapted to receive the vertically extending guide members which are formed on the bulkheads of the container ship hold.

35 Claims, 14 Drawing Sheets

U.S. PATENT DOCUMENTS

| | | | | |
|---|---|---|---|---|
| 5,688,086 | A * | 11/1997 | Menzemer et al. | 410/68 |
| 5,720,228 | A * | 2/1998 | Clive-Smith | 108/55.1 |
| 5,755,472 | A * | 5/1998 | Clive-Smith | 294/67.1 |
| 5,810,186 | A * | 9/1998 | Lam | 220/1.5 |
| 5,842,821 | A | 12/1998 | Coslovi et al. | |
| 5,919,022 | A * | 7/1999 | La Coste | 414/137.1 |
| 6,027,291 | A | 2/2000 | Sain et al. | |
| 6,077,019 | A * | 6/2000 | Corcoran | 414/281 |
| 6,227,397 | B1 * | 5/2001 | Kim | 220/8 |
| 6,390,743 | B1 | 5/2002 | Metternich | |
| 6,460,227 | B1 | 10/2002 | Hove | |
| 6,513,442 | B1 * | 2/2003 | Miller et al. | 108/53.1 |
| 6,533,510 | B1 | 3/2003 | Sain | |
| 6,877,939 | B1 * | 4/2005 | Tomkins et al. | 410/46 |

OTHER PUBLICATIONS

"Container design and types, Part 2", http://www.containerhandbuch.de/chb__e/stra/stra__03__01__01__02.h . . . , Section 3.10.1.2, dated Nov. 22, 2003.

"ISO Containers", Sea Box Inc., http://www.thomasregister.com/olc/58109661/, dated Nov. 22, 2003.

"M3 Flatrack, Container Roll-in/Out Platform (CROP)", http://www.summa.com/cropphotos.html, dated Nov. 22, 2003.

* cited by examiner

TRANSPORT PLATFORM

CROSS REFERENCE TO RELATED APPLICATIONS

The present application is a continuation-in-part of a U.S. patent application Ser. No. 10/622,536 filed on Jul. 21, 2003 in the name of Bernard S. Sain, the entire contents of which are hereby incorporated by reference.

BACKGROUND OF THE INVENTION

1. Field of the Invention

The present invention relates generally to transport platforms for transporting cargo on container ships, and more specifically to open transport platforms for transporting large vehicles/equipment and the like type of cargo and which are adapted for stacking both above and below the decks of container ships.

2. Description of the Related Art

Open transport platforms, which have been used to transport vehicles or the like, have, due to their configuration and limited structural strength, had to be left to last during the loading process so that they can be placed on top of the uppermost containers on the deck of the container ship. That is to say, due to the limited ability of the platforms to bear large vertically acting loads such as those generated by the placement of a fully laden container on top thereof, the platforms have had to be disposed at the very tops of the container stacks. This, of course, severely limits both their utility and the number of platforms which can be carried on any one vessel.

A further drawback that open transport platforms have suffered from results from the fact that the holds of modern container ships are usually constructed to receive predetermined sized containers which are usually 40'×8' long ISO (International Standards Organization) containers. These holds have bulkheads at each end which extend laterally from port to starboard. These bulkheads are each provided with vertically extending cell guides that are sized to permit the 40'×8' ISO sized containers to be slid down between T-shaped guide members which define the cell guides, and thus be securely held at each end thereby.

With this construction, the containers can be secured against both rolling and pitching of the container ship. That is to say, disposition of 40' containers between the bulkheads, which are spaced by about 40', prevents fore-aft movement of the containers due to pitching of the vessel during transit, while the engagement of the ends of the containers with the T-guides prevents lateral movement (port/starboard movement) due to rolling of the vessel. It should be noted that it is also possible with this type of arrangement to dispose two 20' ISO containers in an end-to-end arrangement, between the bulkheads.

After a hold is filled with the above-mentioned types of ISO containers, a hatch is placed over the top to close the hold. Containers are then stacked on top of the hatches.

However, it has been extremely difficult, if not impossible, to dispose anything but the 40'×8' ISO containers in the hold and attempts to dispose transport platforms below deck have not met with any success. Thus, storage in such holds has been limited to the above mentioned 40'×8' ISO containers which are dimensioned to fit in the cell guides. This means that off-sized containers or platforms, which are either wider or narrower than the width of the cell guides, cannot be secured below deck in the holds and are relegated to possible disposition above deck.

As will be readily understood, in many instances it is highly desirable to store cargo which is being carried on an open transport platform, below deck so as to enclose same and thus limit the amount of exposure to the elements during shipping.

A solution to this problem has been wanting.

SUMMARY OF THE INVENTION

The invention is directed to solving the above mentioned problems and to increasing the size and variety of cargo which can be carried on a container ship by open transport platforms, both below deck in the holds of the container ships, as well as on deck.

The embodiments of the invention allow military equipment, for example, which cannot be loaded onto container ships and which is normally limited to surface transport in highly specialized "roll-on/roll off" ships, to be transported using conventional container ships. In that container ships far outnumber the roll-on/roll off types, and can carry more cargo, the amount of cargo/equipment which can be moved, should the need arise, is greatly increased and the need to build large numbers of the above-mentioned specialized vessels is attenuated. The fact that container ships are also more prevalent overcomes the problem that would result if one of the specialized roll-on/roll/off ship was required to sail from one side of the Pacific ocean to the other to pick-up cargo destined for a war zone or the like. Similar advantages carry over into the private sector in that large equipment which hitherto could not be transported economically on container ships, can now be loaded in large numbers with the advent of the embodiments of the invention.

A first aspect of the invention resides in a transport platform comprising: a platform; and adjustable length pillars provided either side and at both ends of the platform, the adjustable length pillars each having an upper cross-member interconnecting the upper ends thereof.

In this arrangement the platform is provided with cross-members which are connected with the platform and which extend parallel with the upper cross-members. These upper and lower cross-members are provided with openings by which the upper and lower cross-members are engageable with structural members adapted to hold the platform in a predetermined position during transit.

In one embodiment, the structural members comprise connection rails used to connect the transport platform to one or more adjacent containers. In another embodiment, the structural members comprise vertically extending guide members which are fixed to container ship bulkheads and which define so called "cell guides" therebetween.

In the latter mentioned arrangement, the openings in the upper and lower cross members comprise spaced vertically extending slots which are adapted to engage the vertically extending guide members. Alternatively, in the former arrangement, the openings in the upper and lower cross members comprise openings formed in twist lock castings which are connected with the upper and lower cross members to allow for twist lock devices to interconnect the upper and lower cross members with the connection rails.

A further embodiment resides in that the upper and lower cross members are adjustably connected to a frame of the platform so as to be laterally adjustable within a predetermined limit with respect to the frame of the platform.

The above mentioned adjustable length pillars each comprise a base member rigidly connected with the platform and a telescopic member which is slidably disposed with the base member. The adjustable length pillars each further comprise a locking device which selectively locks the telescopic member in one of a plurality of positions relative to the base member. A locking device is arranged with the pillars and includes a locking pin which is disposed through apertures which are formed in the telescopic member and the base member of the adjustable length pillars.

A cargo connection device can be provided on the above mentioned platform and arranged to facilitate connection of cargo thereto. This cargo connection device is movable and selectively positionable on the platform.

A second aspect of the invention resides in a transport platform arrangement comprising: a transport platform having a platform and pillars provided either side and at both ends of the platform. The adjustable length pillars each having an upper cross-member interconnecting the upper ends thereof. The arrangement further includes first connection rails which are disposed over and connectable to the upper cross-members, the first connection rails being connectable to at least one container which is disposed adjacent the transport platform.

In this arrangement, the platform further comprises lower cross-members fixed thereto, the lower cross-members being parallel to the upper cross-members. The transport platform further comprises first connection devices which are used to interconnect the first connection rails to the upper cross-members and to an upper side of the at least one adjacent container.

A third aspect of the invention resides in a transport platform comprising: a platform having first and second end members in which spaced vertically extending first slots are formed, the first slots being adapted to receive one of a plurality of vertically extending guide members that are provided on bulkheads of a container ship hold; first and second sets of vertically extending pillars which are respectively provided at first and second ends of the platform; and first and second cross members respectively interconnecting the upper ends of the first and second sets of pillars, the first and second cross members each having spaced vertically extending second slots that are aligned with the vertically extending first slots and which are adapted to receive the vertically extending guide members which are formed on the bulkheads of the container ship hold.

In this platform, the first and second end members and the first and second cross members are adjustably connected to the platform so as to allow a position of first and second end members and the first and second cross members to be laterally adjustable with respect to the platform. The platforms are also wider than a distance between adjacent vertically extending guide members.

Additionally, in this platform the first and second slots are respectively spaced in a predetermined relationship with a width of the platform and a distance between the vertically extending guide members which are disposed on the bulkheads. The first and second slots are spaced so that a number of platforms can be disposed side-by-side across the bulkhead of the container ship hold in manner wherein the number of spaces between the guide members is different from the number of platforms.

The pillars are telescopic and selectively adjustable in length and comprise upper and lower halves. The upper halves are slidable in the corresponding lower halves, and locking arrangements are provided with each of the pillars for selectively locking the upper half in a selected positions relative to the lower half.

In one embodiment of the platform, the pillars are each pivotally supported on the platform in a manner which allows each pillar to be pivoted to a position wherein it is essentially parallel to a deck of the platform. In this case, the pillars are provided with pillar projections which extend toward the ends of the platforms and which have slots formed therein, the slots in the pillar projections having essentially the same width and depth as the slots in the end member and which are aligned with one of the slots in the end members. Brace members interconnect portions of the pillars with a portion of the platform.

In this platform the first and second end members and the first and second cross members each have an apertured casting at each end, and wherein the castings are adapted to receive connection members and to enable the first and second end members and the first and second cross members to be detachably connected to elongate connection rails which are used to interconnect the transport platform with an adjacent structure. These connection members comprise twist lock devices.

A further aspect of the invention resides in a method of disposing transport platforms below deck in a hold of a container ship wherein the fore and aft bulkheads of the hold are provided with vertically extending guide members, comprising: selectively disposing the transport platform in the hold so that one of the vertically extending guide members is slidably engaged in one of a plurality of spaced vertically extending first slots formed in an end member provided at each end of the platform, to prevent movement of the platform relative to the hold of the container ship. This method further comprises holding the platform in a predetermined position within the hold using a plurality of spaced vertically extending second slots wherein the vertically extending second slots are formed in a cross member which interconnects the upper ends of pillars that extend up from the platform proximate the ends of the platform, and wherein the vertically extending second slots are respectively aligned with the vertically extending first slots formed in the end members at each end of the platform.

Yet another aspect of the invention resides in a method of disposing transport platforms in a hold of a container ship wherein the hold has fore and aft bulkheads which are each provided with a plurality of spaced vertically extending guide members between which cell guides are defined, comprising: providing spaced vertically extending slots in each end of each transport platform wherein the plurality of spaced vertically extending slots are spaced in accordance with a predetermined relationship between a width of each transport platform and a distance between the spaced vertically extending guide members which define the cell guides, and wherein each slot is dimensioned to receive a guide member therein; and disposing the platforms in the hold in a side-by-side relationship so that a number of the platforms and a number of cell guides which are occupied by the platforms are different.

This method further comprises adjustably connecting end members in which the vertically extending slots are formed to the transport platform and allowing the end members to be laterally adjustable with respect to the platform. In addition, the method further comprises providing telescopic masts on the platform; interconnecting the upper ends of the masts with upper cross members that each have portions in which vertically extending slots, which correspond to the vertically extending slots formed in the end members, are formed; and connecting the portions of the upper cross members in which the vertically extending slots are formed so as to be adjustable with respect to the remainder of the upper cross members so that portions of the upper cross members in which the vertically extending slots are formed are laterally adjustable with respect to the remainder of the upper cross members.

BRIEF DESCRIPTION OF THE DRAWINGS

The various aspects and advantages of the embodiment of the present invention will become more clearly appreciated as a description thereof is given with reference to the appended drawings in which.

DETAILED DESCRIPTION OF THE EXEMPLARY EMBODIMENTS

Figure 1:
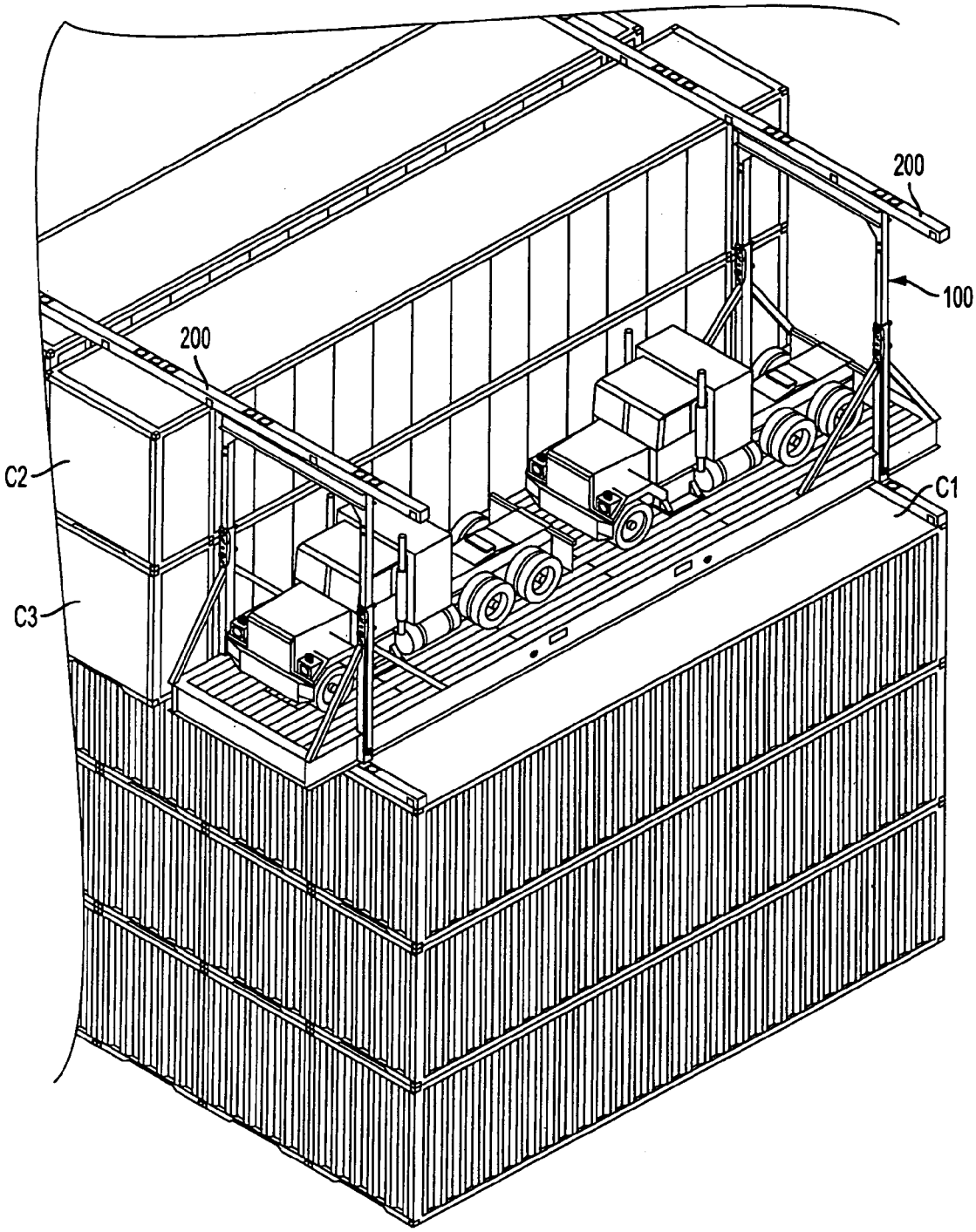
FIG. 1 is a perspective view of a first embodiment of the transport platform according to the present invention, showing an "on deck" disposition with a plurality of platforms and containers and in a situation wherein a container or containers can be disposed on top of one or more of the platforms.
Figure 2:
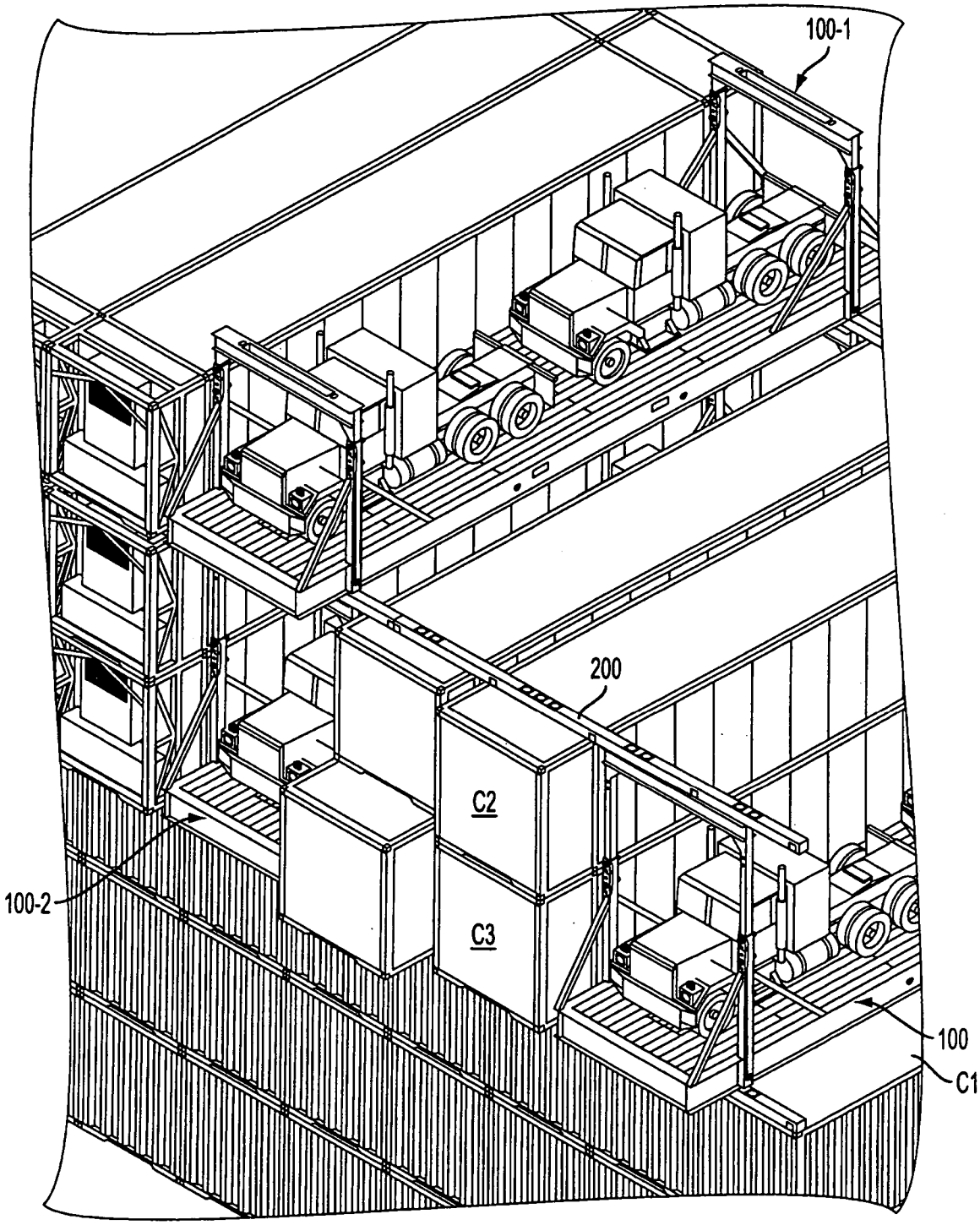
FIG. 2 is a perspective view similar to that shown in FIG. 1 depicting the arrangement wherein two transport platforms are arranged one on top of the other.
Figure 3:
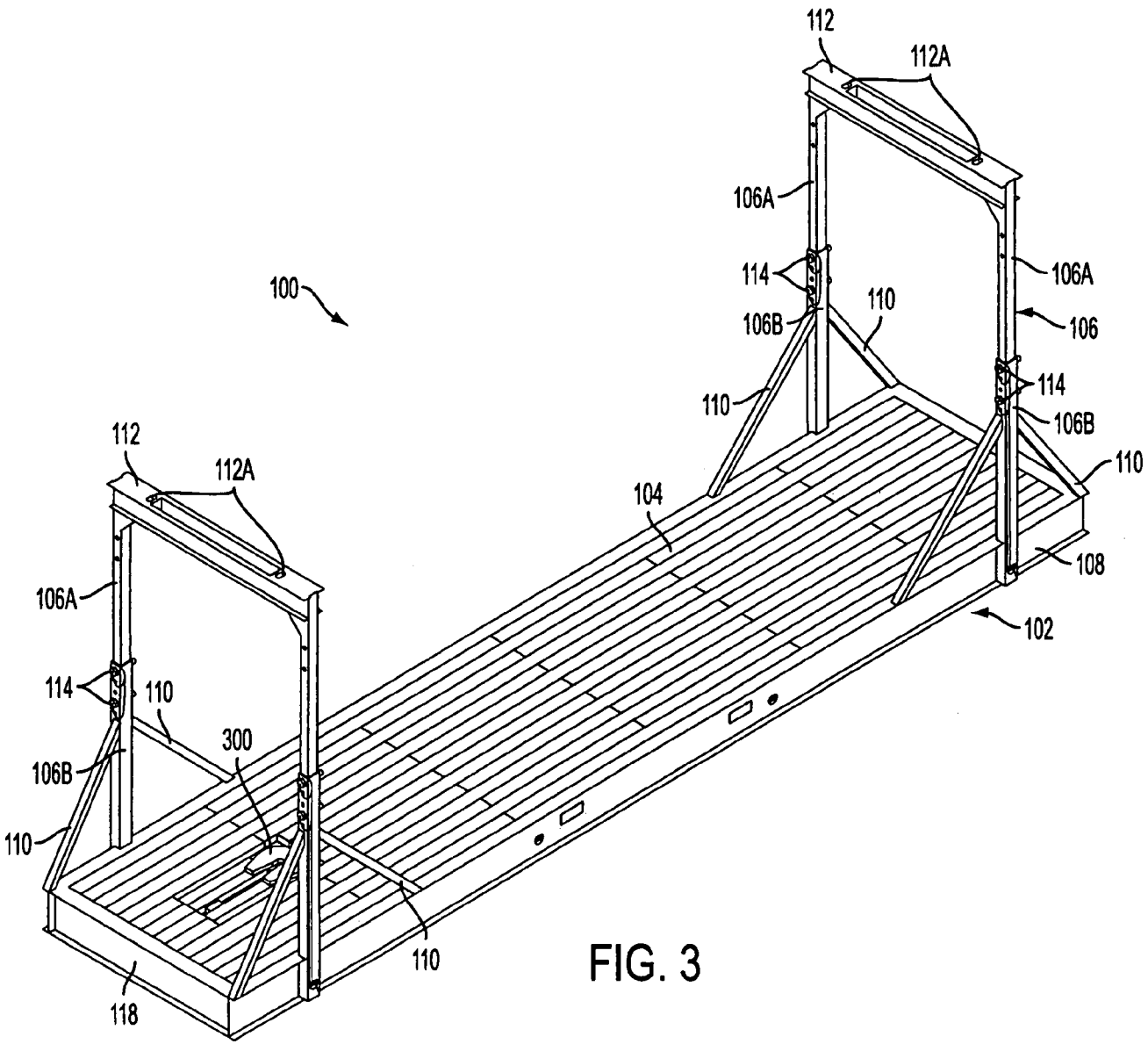
FIG. 3 is a perspective view the first embodiment of the transport platform.

FIGS. 1–6 show an embodiment of a transport platform 100 according the present invention. This embodiment is adapted for above-deck disposition. In this arrangement, as best seen in FIG. 3, a basic platform comprises an I-beam frame or chassis 102 with a planked floor 104 supported thereon. The planking can be either metal or wood. Pairs of pillars or masts 106 are arranged proximate each end of the platform chassis 102. The lower ends of these pillars 106 are secured to the outer sides of side I-beams 108 which form part of the I-beam chassis 102. These pillars 106 are braced in position by angled reinforcing members 110 which, in this embodiment, extend at angles between the pillars and the upper edges of the side I-beams 108 and which are securely welded in position.

Each of the pillars 106 are telescopic so that the height of each of the I-beam upper cross-members 112 which interconnect the upper ends of each end of the telescopic portion 106A with each of the base members 106B of the pillars 106, can be adjusted and locked in a selected one of a predetermined number of positions. These positions are selected with respect to the different heights of the different sized/types of containers beside which this embodiments of the transport platforms 100 can be disposed.

In the illustrated embodiment, the interlocking of the telescopic members 106A with the base member 106B of the pillars 106 is achieved using locking pins 114 and a series of apertures formed in each of the stationary base and telescopic upper ends 106B, 106A of the pillars. Once the upper ends 106A are in the required relative positional relationship with respect to the base members 106B, a locking pin 114 can be inserted through each set of mating apertures to lock the pillars in the desired condition. The locking pins 114 may take the form of bolts so that a nut can be placed on the ends to ensure that vibration and the like does not induce any undesirable movement or disengagement of the pins. Alternatively, the pins 114 may be smooth and can be provided with some other suitable form of securing arrangement such as cross pins or the like to prevent unwanted movement during shipping.

As noted above, the telescopic pillars 106 can be set to a plurality of different heights. These heights are selected to correspond to the heights of differently sized containers and further set to a fully collapsed minimum height position which facilitates storage when not in actual use (see FIG. 6).

A fully extended position or maximum height of the pillars 106 is selected to be higher than the tallest conventional closed type containers. An example of this setting is shown in FIG. 2, wherein transport platform 100-1 is disposed atop of platform 100-2 and wherein the pillars 106 of the upper transport platform 100-1 are set at their maximum height.

This maximum height setting shown in FIG. 2, can be used to facilitate location and engagement with a lifting apparatus such as a spreader when the platform is placed on the very top of the container stack such as illustrated in FIG. 2.

The upper cross-members 112 are formed with apertures 112A into which twist locks associated with the connection rails or beams 200, can be disposed and engaged with the cross-members when the connection rails 200 are placed in position in the manner illustrated in FIGS. 1 and 2. These connection rails 200 are interconnected to the tops and bottoms of container and platforms through twistlock devices. The interposition of these connection rails 200 between layers in the container enables vertical load to be shared between the containers and the masts of the first embodiment of the transport platforms. These rails 200 also laterally interconnect the containers and platforms so as to create a unit of interconnected elements which interlocks the stacks together and prevents lateral movement of any one container with respect to an adjacent container/platform.

The platforms are constructed in a manner wherein lower cross-members 116 extend across the lower surface of the transport platform 100 at locations inboard of end I-beams 118 which are provided at the ends of the platform 100. These lower cross-members 116 are provided with apertures into which twist locks can be disposed. These lower cross-members 118 are, like the remainder of the platform chassis 102, formed of I-beam and are securely welded to the side beams 108 of the platform chassis 102.

An adjustable device 300 for facilitating "tie-down" of vehicles and the like, is provided in the floor 104 at one end of the transport platform. This device 300 can, of course, be omitted or replaced with other members which facilitate the securing of tie-down cables/chains or the like. Alternatively, two or more of these devices can be disposed on the floor 104 as desired.

The above-described transport platform embodiment is adjustable and dispositionable above-deck in the manner depicted in FIGS. 1 and 2. As shown in FIG. 1, a transport platform 100 according to the first embodiment of the invention, is disposed atop a container C1 and adjacent two other containers C2, C3 by way of two connection rails 200. As shown, the connection rails 200 extend between the transport platforms 100-1 and 100-2 in manner which allows twist locks 210 to interconnect the two, and then extends over two more containers (including container C1) and further over the upper cross-member 112 of the transport platform disposed immediately beside containers C2 and C3.

As will be appreciated, the first embodiments of transport platforms 100 according to the invention are able to treated/used as if they were normal closed containers and thus be disposed anywhere in the above-deck container stack via the use of the connection rails 200. The utility of this arrangement will be immediately appreciated by those involved with container loading and unloading and how this alleviates the need to previously schedule the loading to avoid loss of cargo carrying capacity.

Figure 4:
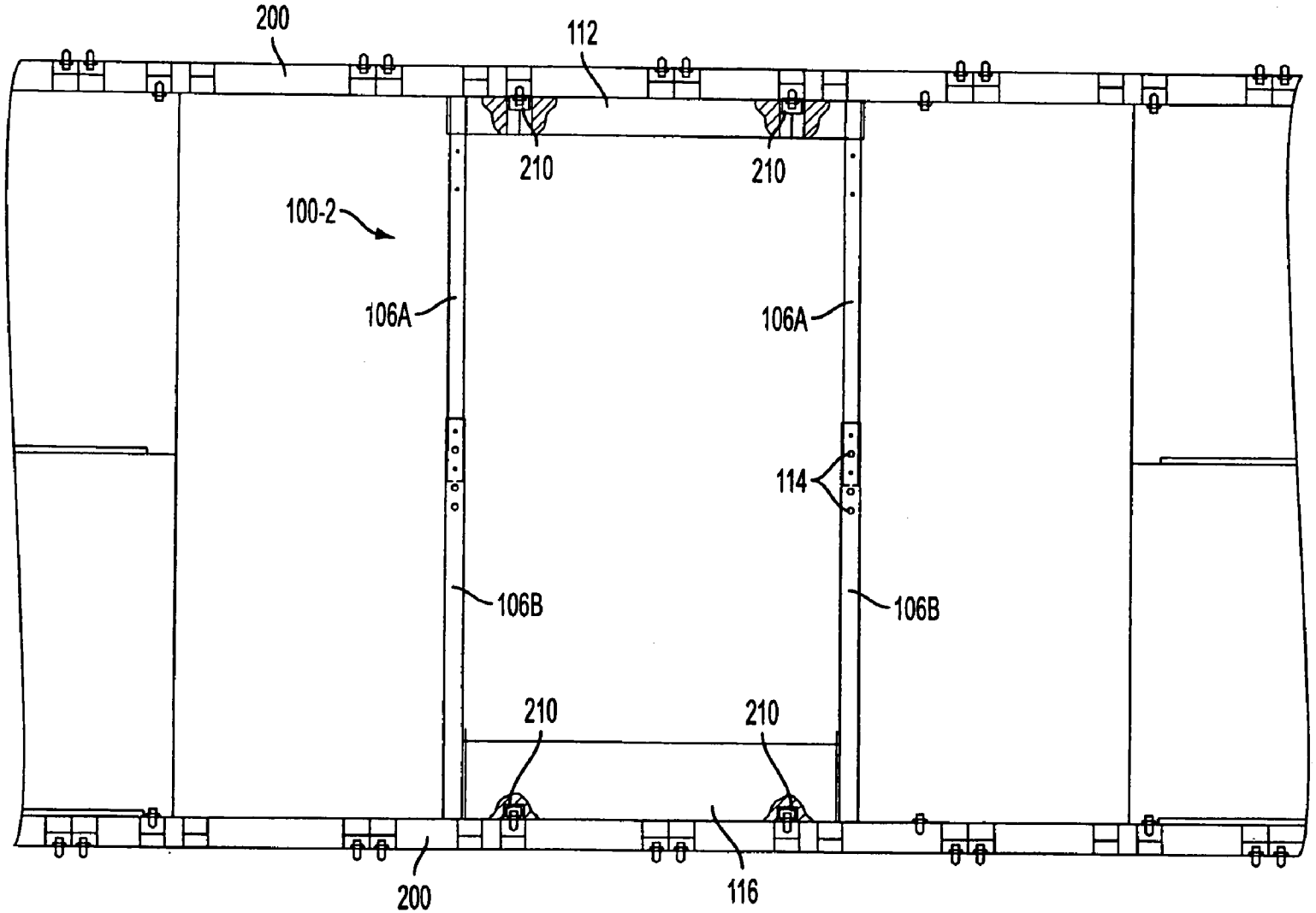
FIG. 4 is an end elevation of the platform of the first embodiment showing the manner in which the platform can be connected with connection rails or beams in the manner depicted in FIG. 1.
Figure 5:
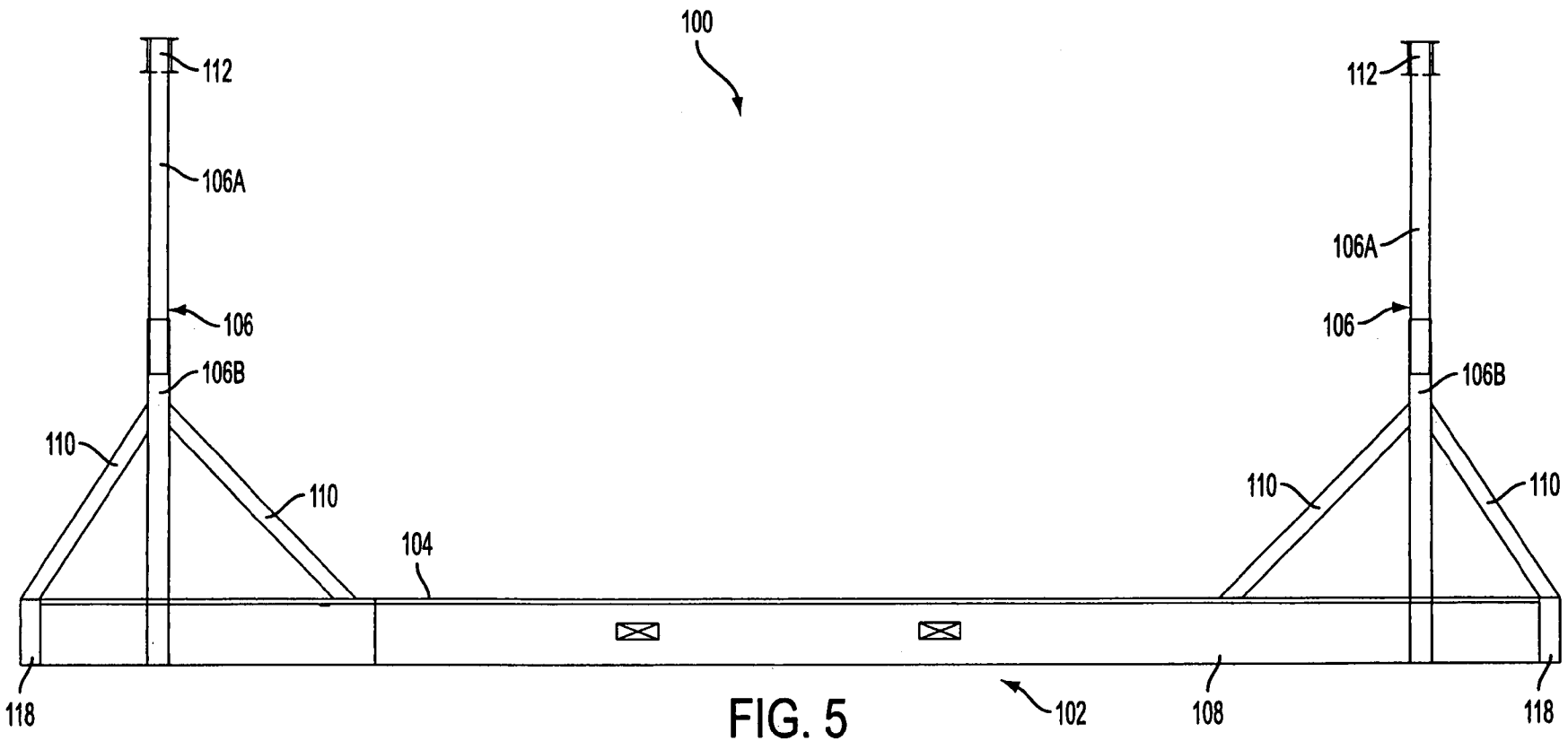
FIG. 5 is a side elevation of the transport platform embodiment.
Figure 6:
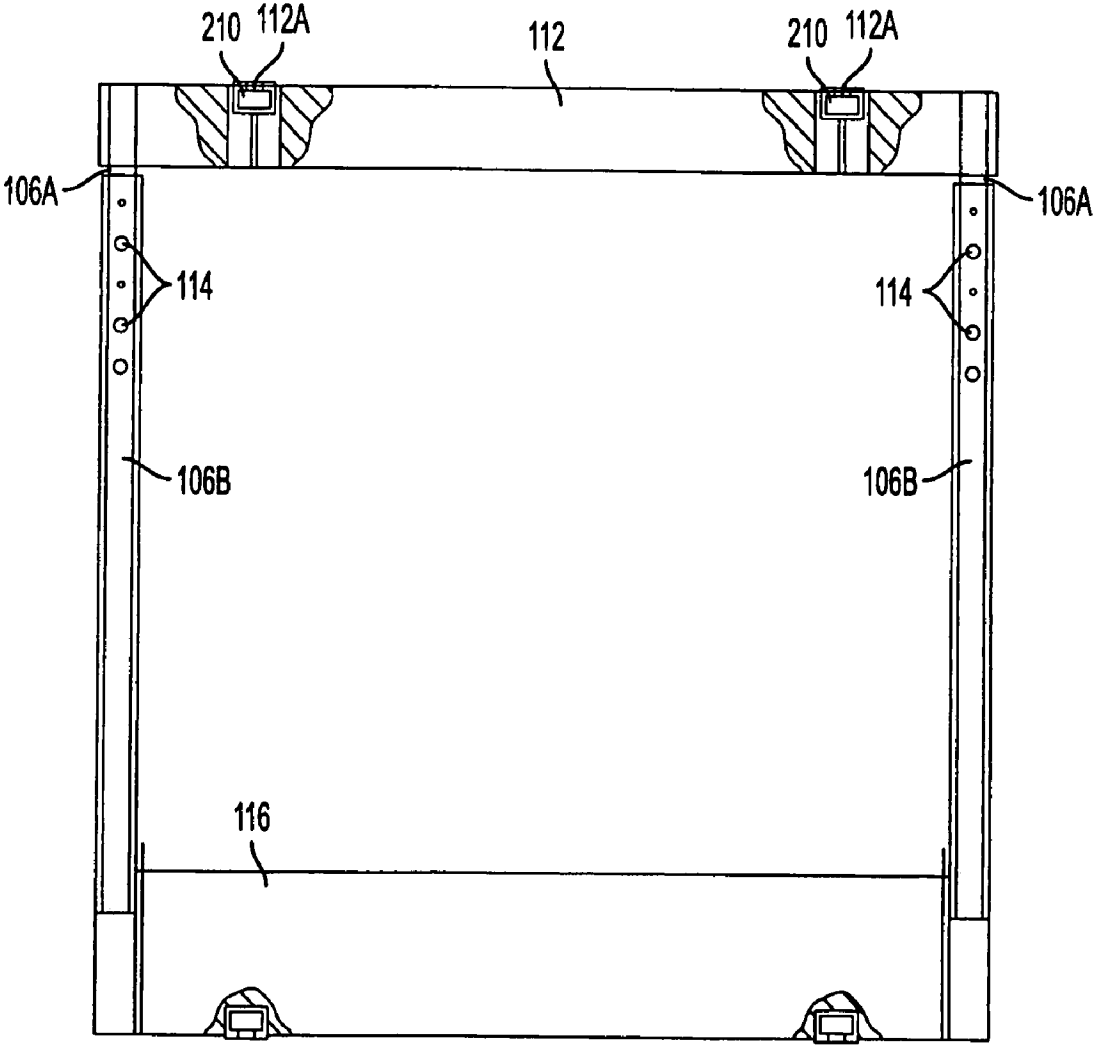
FIG. 6 is an end view showing the support posts of the transport platform lowered to a minimum height.

As noted above, the connection rails 200 are connectable to containers on either side of the transport platform 100. This is also shown in FIG. 4. This type of connection permits a fully-loaded, closed-type container to be disposed directly on top of the transport platform 100 once a transport platform has been disposed in position and connected to the two connection rails on which the platform is seated and the two connection rails which extend over the upper cross-members 112. This connection rail arrangement permits the vertically acting load to be in part shared with the adjacent containers while interconnecting the platforms/containers in a manner which prevents relative movement.

FIGS. 7–23 show a second embodiment of the invention. This embodiment is applicable to below-deck storage in the holds which have thus far been limited to the 40'×8' ISO containers for reasons address above. These holds are formed along the almost the whole length of the container ship in order to maximize the cargo carrying capacity of the same. The width of the holds in the parallel mid-body of the ships remains constant. However, in the bow and aft sections of the vessel, the tapering configuration of the ships hull demands that the widths of the holds reduce as they approach the ends of the vessel.

Figure 7:
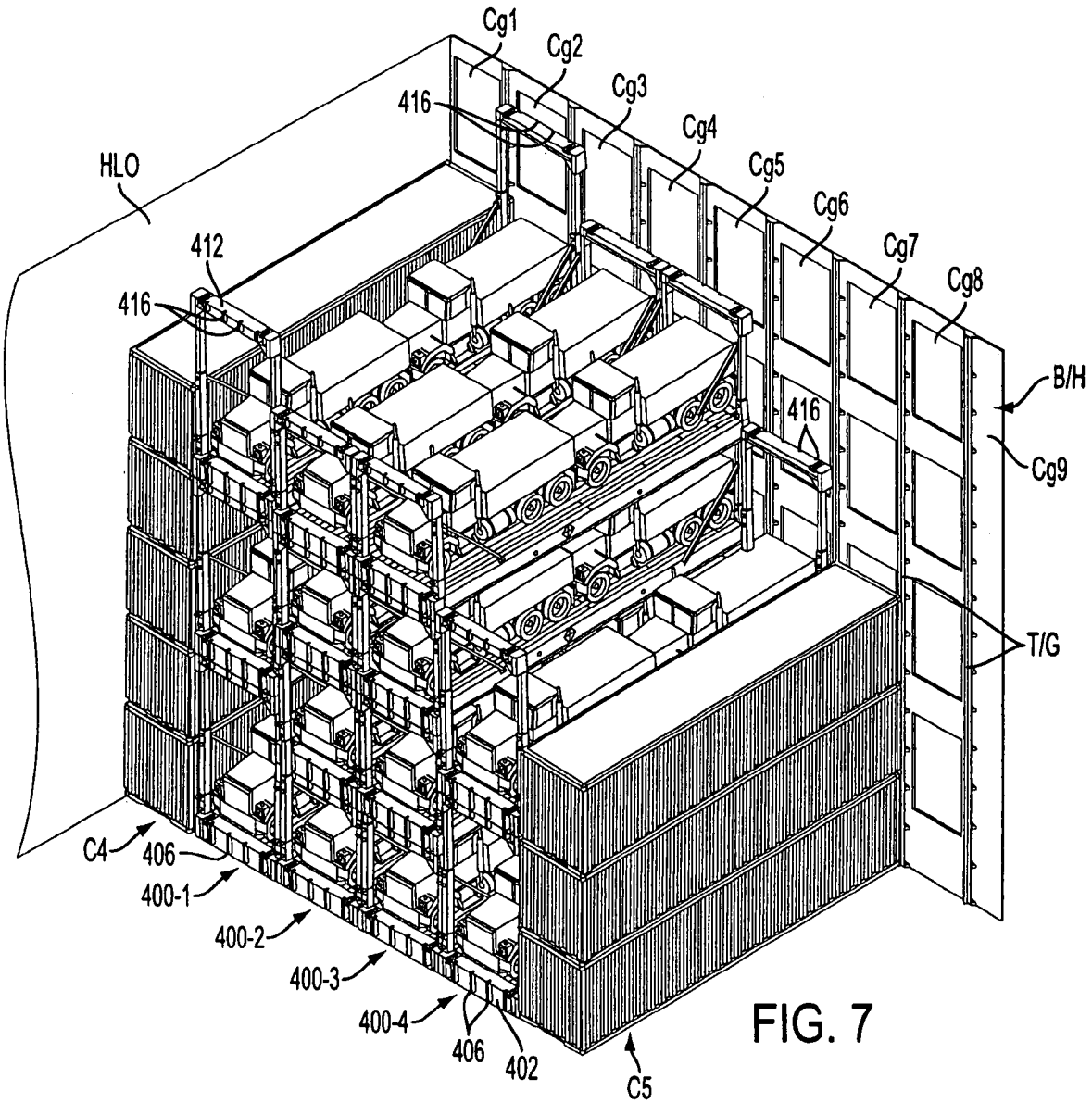
FIG. 7 is a perspective view showing the manner in which containers and transport platforms according to a second embodiment of the invention can be securely disposed in a hold of a container ship making use of the guides which are provided as standard equipment on the fore and aft bulkheads of the hold.

FIG. 7 is a perspective view showing, merely by way of example, a stack of 40' ISO containers C4; four stacks of transport platforms 400 (400-1 . . . 400-4) according to the second embodiment of the invention; and a further stack of ISO containers C5, which are disposed in a hold HLO in the illustrated manner. The bulkhead B/H is shown as having a plurality of vertically extending T-guide members T/G rigidly connected thereto. Cell guides Cg1, Cg2, Cg3 . . . Cgn in which ISO containers can be slidably disposed are defined between each adjacent two of the T-guide members T/G. Empty cell guides Cg8, Cg9 are shown at a right hand side of the figure.

The second bulkhead, which is essentially a mirror image of the illustrated one, is arranged at the second ends of the containers/platforms. This second bulkhead is omitted from the drawing for the sake of illustrative clarity.

Figure 8:
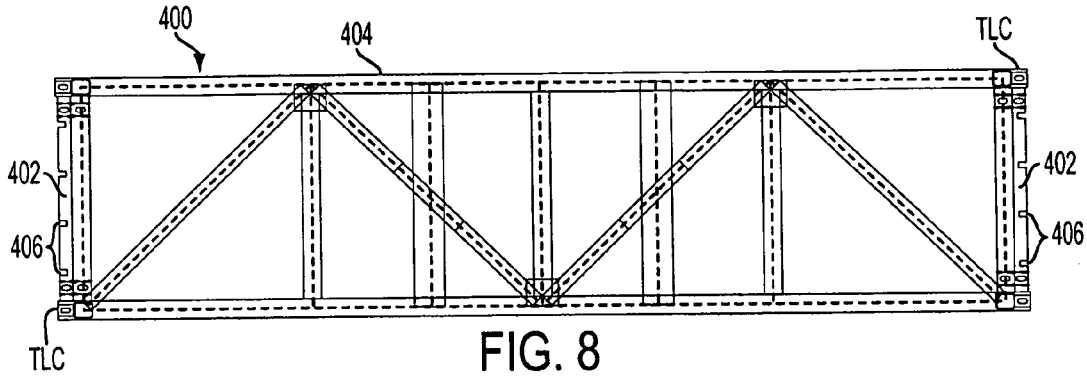
FIG. 8 is a top plan view of the second embodiment of the transport platform according to the present invention showing an example of a platform frame.
Figure 9:
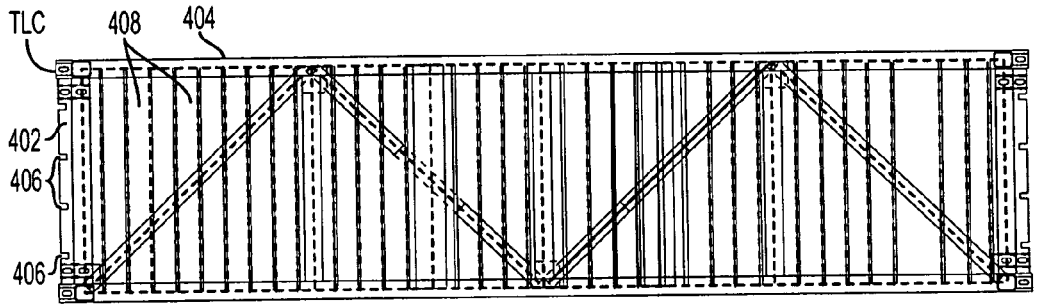
FIG. 9 is a top plan view the arrangement shown in FIG. 8 wherein a deck is provided on the platform frame.
Figure 10:
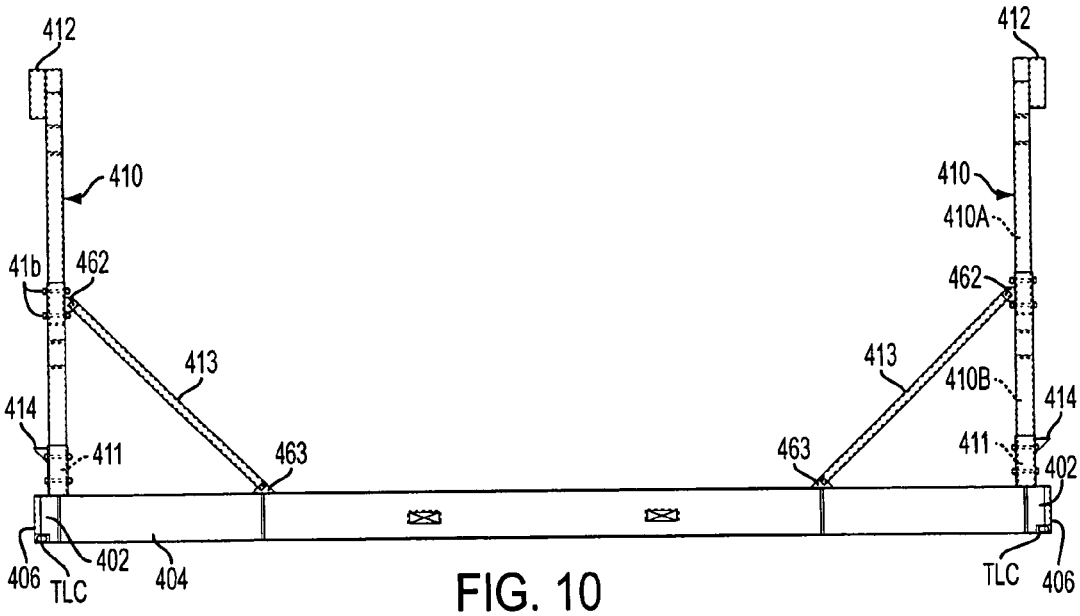
FIG. 10 is a side view of the second embodiment of the invention.

As shown in FIG. 8, cross members 402 which extend across the very ends of the platforms of the transport platform frames 404 are each provided with a plurality of spaced, vertically extending slots 406 which are sized in terms of width and depth to slidably receive the T-guide members T/G illustrated in FIG. 1. In connection with this embodiment, these cross members 402 will hereinafter be referred to as "end members."

The depth and width of the slots 406 are selected to allow for ship-to-shop variations in the dimensions of the T-guide members T/G and are such as to leave a small amount of clearance that is sufficient to avoid interference between the T-guide members T/G and the sides of the slots 406 while avoiding any significant lateral movement that may be problematical during transit.

Figure 14A:
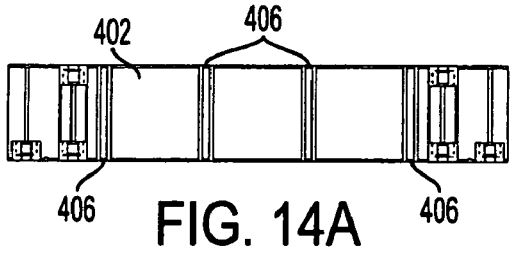
FIG. 14A is an end view of an end of the transport platform (shown in FIGS. 8 and 9) showing the provision of the vertically slots (shown in FIG. 11) along with associated twist lock corner castings.

As shown in FIG. 14A, the end members 402, in a variant of this embodiment, are adjustably connected to the ends of the frames so as to enable the positions of the end members 402 to be adjusted laterally with respect to the frames 404. This can be achieved by connecting the end members 402 and the frames by way of a plurality of large bolts (0.5–1.0 inch by way of example) and providing at least one of the frame 404 and the end member 402 with a corresponding number of horizontally extending elongate bolt holes (slots) 402S. The length of the horizontally extending elongate bolt hole 402S allows the end member 402 to be loosened via the loosening of nuts 402N and slid sideways with respect to the frame 404 proper by about the length of the elongate holes 402S minus the diameter of the bolts. Merely by way of example, the amount of adjustment provided by the elongate holes is about 4 inches. This adjustability allows for the position of the platform 400 to be adjusted with respect to the hold HLO and can be useful for locating a platform 400 with the appropriate clearance with respect to the side of a hold or the like and avoiding any potential problematical interferences which might occur on a ship-to-ship or even hold-to-hold basis and hinder the loading and stacking process.

The platforms frames 404 are, as shown in FIG. 4, provided with decking 408 (see FIG. 9) to support cargo and are further with vertically extending pillars or masts 410 at each end.

Figure 11:
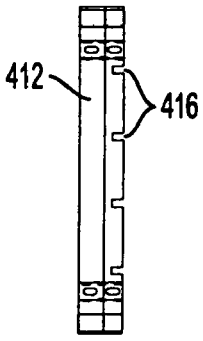
FIG. 11 is a top plan view of a cross-member which extends between and interconnects vertically extending support posts/pillars.
Figure 12:
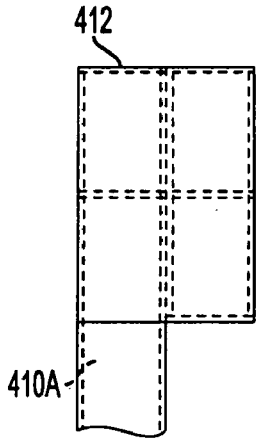
FIG. 12 is a side view of an upper end portion of the arrangement shown in FIG. 11.
Figure 13:
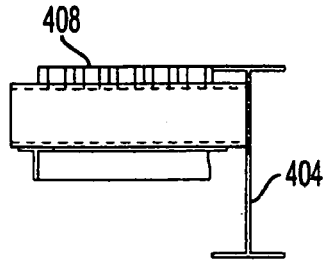
FIG. 13 is a sectional view of an edge portion of the main frame showing an I-beam construction and the provision of the decking shown in FIG. 9.

The upper ends of pillars 410 are connected with upper cross-members 412 which are, as shown in plan in FIG. 11, provided with a set of vertically extending slots 416 that correspond positionally with the vertically extending slots 406 formed in the end members 402 of the platform 400. FIG. 7 shows how the aligned slots 406, 416 enable engagement with the vertically extending T-guide members T/G and hold the platforms 400 against lateral movement within the hold HLO.

Figure 15A:
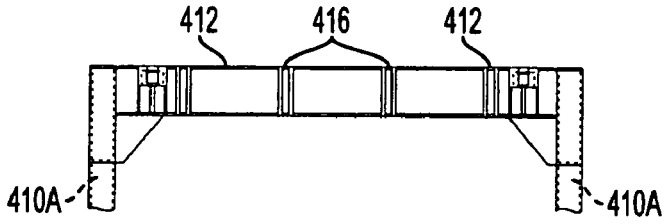
FIG. 15A is an end view of the cross member which interconnects the upper ends of the vertically extending pillars or posts, and which shows the provision of vertically extending slots which correspond to those formed in the end member shown in FIG. 14.
Figure 14B:
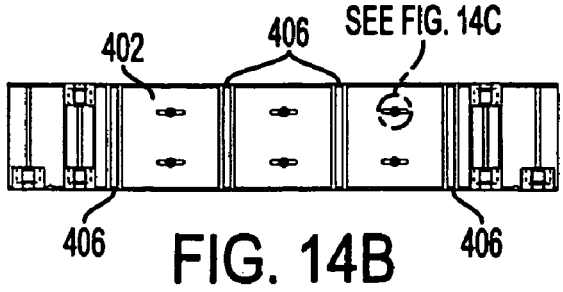
FIG. 14B is a end view similar to that shown in FIG. 14A but which shows the provision of adjusting slots/bolts which allow the end member, in which the vertically extending slots are formed, to be loosened and laterally adjusted with respect to the platform frame shown in FIG. 8.
Figure 14C:
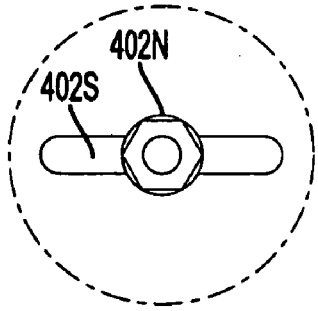
FIG. 14C is an enlarged view showing one of the slots and bolt/nut arrangements which are used to render the end member shown in FIG. 14B, adjustable.
Figure 15B:
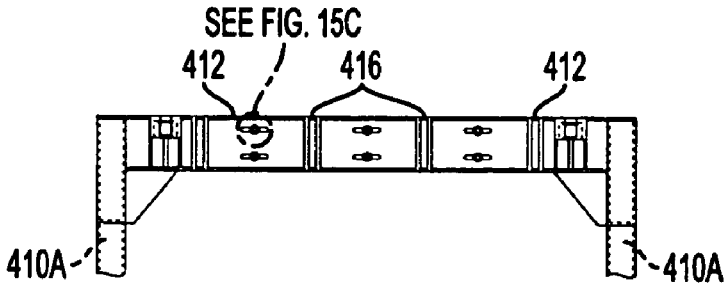
FIG. 15B is an end view similar to that shown in FIG. 15A but wherein slots and bolt/nut arrangements similar to those provided in the end member (shown in FIG. 14B), are provided and arranged in a two-part cross member which interconnects the upper ends of the pillars or posts and which allows one part to be laterally adjustable with respect to the other, and thus allow the vertically extending slots which are formed therein, to be adjusted to positions which correspond to those in the adjustable end member shown in FIG. 14B.
Figure 15C:
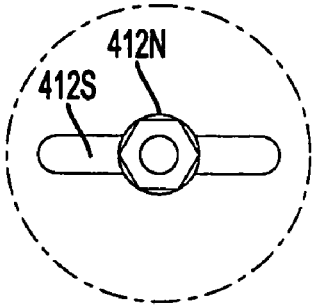
FIG. 15C is an enlarged view showing one of the slots and bolt/nut arrangements which are used to render the cross member shown in FIG. 15B, adjustable.

As shown in FIG. 15A, the cross members 412, similar to the end members 402, can be also be rendered laterally adjustable through the use of a two-piece cross member wherein one half is rigidly connected to the upper ends of the masts 410 and wherein the two halves are provided with a bolt and horizontally elongate bolt hole arrangements 412S/412N which is basically similar to the bolt hole arrangements 402S/402N and which allows the cross members 412 (viz., the half in which the vertically extending slots are formed) to exhibit essentially the same amount of lateral adjustability as the end members 402.

It will be noted that, in the second embodiment, the masts 410 are located closer to the ends of the platform 400 as compared with the masts 106 platforms 100 according to the first embodiment. This allows the cross members 412 to be located in a position wherein the slots 416, which are formed therein, are located directly above the respective slots 406 that are formed in the end members 402.

It will of course, be understood that the stacking order/arrangement which is depicted in FIG. 7 is merely an example of the many possibilities that can be achieved and is in no way to be taken as a limit to the utility of the invention.

With this second embodiment, a spreader can be used to pick up platform 400 after platform 400 and lower each to the cell guides in a manner wherein, irrespective of the fact that the illustrated platforms are wider than the cell guides, the spacing of the vertically extending slots 406, 416 and the guiding effect of the T-guides T/G allows the platforms 400 to be lowered down into the hold HLO so as to be located neatly side-by-side.

In more detail, the arrangement illustrated in FIG. 7 is such that a first stack of ISO containers C4 are arranged so that the ends are received in a first set of cell guides (one at each end of the stack). Beside this first stack of containers C4, is a first stack of transport platforms 400-1. As will be appreciated, each of the platforms 400 in this stack 400-1 is wider than the adjacent stack of ISO containers.

To secure the ends of the first stack of platforms 400-1, one of the T-guides T/G is received (in this illustration) in the end most set of aligned slots 406, 416 which are formed respectively in the cross and end members 412, 402. This allows a portion of the platform 400 (which is, as noted above, wider than the cell guide) to extend from the second cell guide Cg2 into the third cell guide Cg3. The next stack of platforms 400-2 is disposed so as to span the third and fourth cell guides (Cg3, Cg4) and to have a T-guide C/G received in a second from the end set of vertically aligned set of slots 406, 416. The following stack of platforms 400-3 is disposed so as to span the fourth and fifth cell guides (Cg4, Cg5) and to have a T-guide C/G received in a third from the end set of vertically aligned set of slots 406, 416. The next, and final stack of platforms 400-4, is disposed so as to span the fifth and sixth cell guides Cg5, Cg6 and to have a T-guide T/G received in the fourth and last set of vertically aligned set of slots.

The width of the platforms 400 and the spacing of the vertically extending slots 406, 416 induces the situation wherein the sixth cell guide Cg6 is filled and the situation is established wherein the edges of the platforms in the stack 400-4 slides along an inboard edge of the T-guide T/G which separates the sixth and seventh cell guides. This, of course, fills the cell guides Cg2–Cg6 and allows the stack of ISO containers C5 to be slid down into the next (seventh) cell guide Cg7 as if nothing but stacks of ISO containers had been loaded into the hold.

By stacking platforms having this width in this manner allows the hold HLO to filled while ensuring that lateral movement of stacks of containers/platforms is securely prevented. Of course this embodiment of the invention is not limited to the illustrated width and platforms which are narrower and wider can be envisaged. While not so limited, the widths of the transport platforms according to this embodiment of the invention can be from 10–16 feet wide by way of example only. Wider platforms are of course possible.

Figure 23:
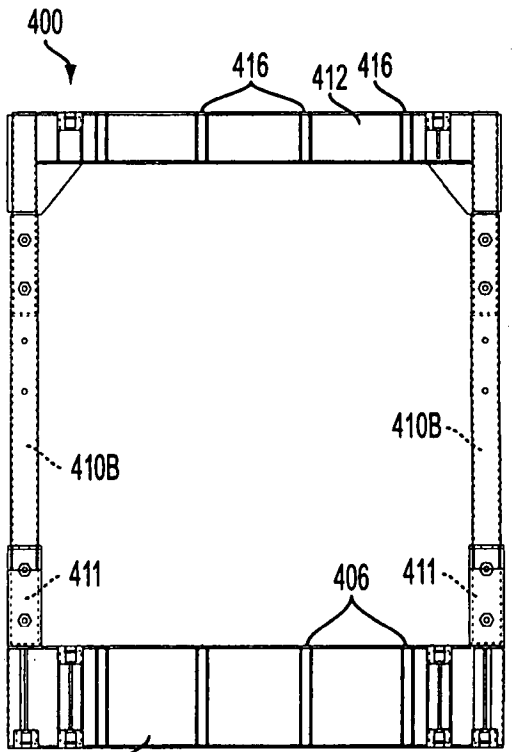
FIGS. 21–23 are end views showing the telescopic nature of the pillars and the manner in which the height of the cross member can be adjusted to at least three different positions to facilitate disposition beside containers of different heights and/or storage.
Figure 22:
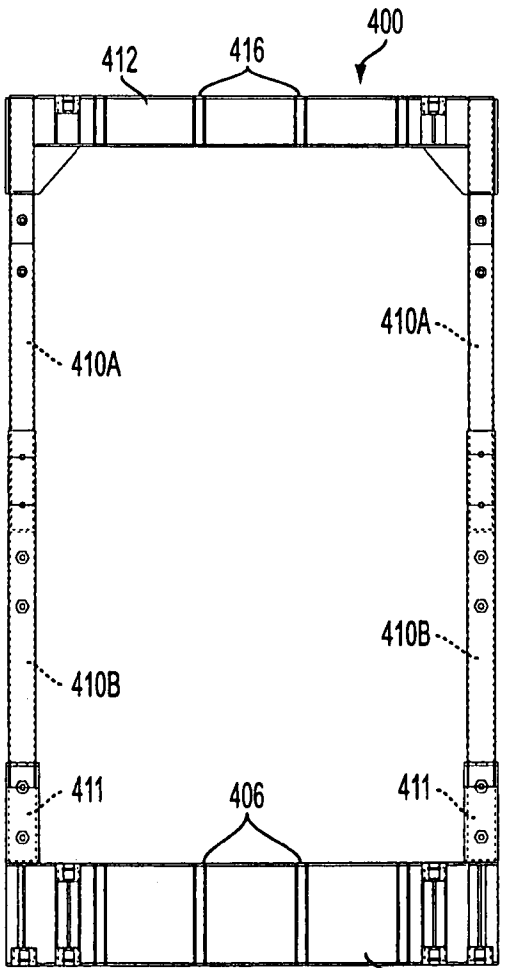
Figure 21:
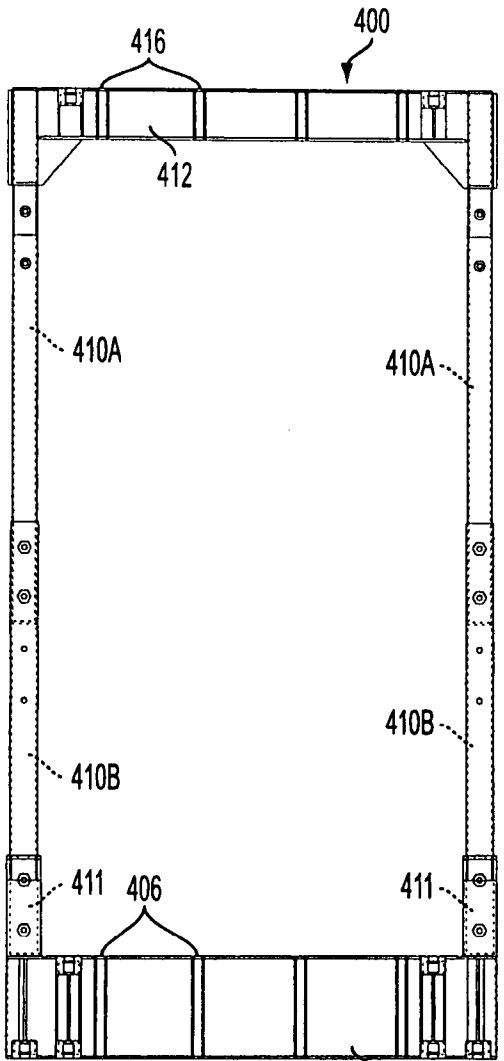

In this second embodiment the pillars or mast 410 are also telescopic so as to be height adjustable in the manner shown in FIGS. 21–23. The upper half of the pillar 410A is slidable with in the lower half 410B in the same manner as in the first embodiment. The upper and lower halves 410A and 410B are locked together by bolts or connection arrangements 41*b* which are similar to those used in the first embodiment. While there are only three stages of height adjustment illustrated, it will be understood that this is not limiting with respect to inventive concept on which the embodiment is based.

Figure 16:
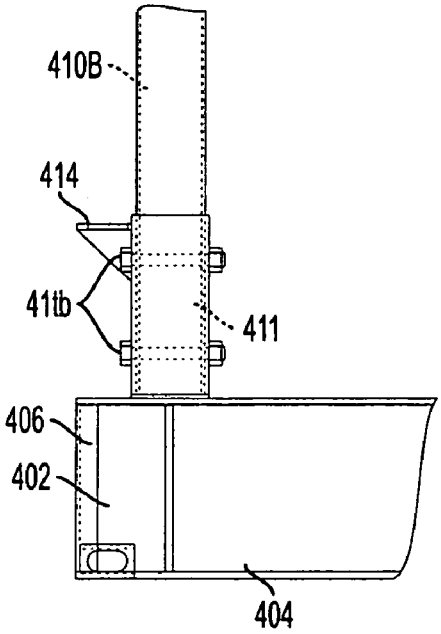
FIG. 16 is an enlarged side view of a base portion of the pillar arrangement of the second embodiment showing the provision of fastening bolts.
Figure 17:
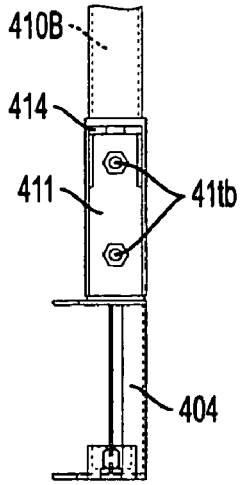
FIG. 17 is an end view of the arrangement shown in FIG. 16.
Figure 18:
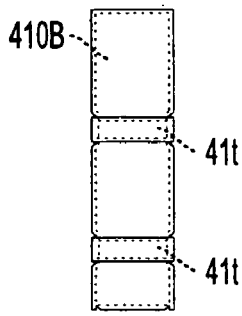
FIG. 18 is a view of a lower portion of the pillars which is shown in FIGS. 16 and 17.

The lower end of the mast 410B is constructed in the manner shown in FIGS. 16–18. Tubular members 41*t* are disposed through and welded into the lower ends of the lower halves 410B to increase the strength and rigidity of the connection between the lower halves 410B of the masts 410 and base members 411 which are rigidly connected to the frame 404 of the platform 400. The base members 411 and the lower ends of the lower mast halves 410B are interconnected by bolts 41*tb*. This allows for the disconnection and removal of the masts 410 should it be desired for stacking/storage or the like.

The bases 411 are provided with tie-down castings 414 as shown in FIGS. 16 and 17.

Figure 19:
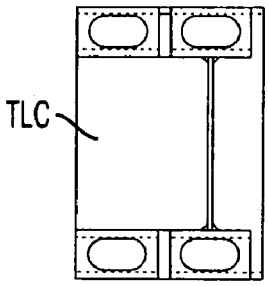
FIG. 19 is a plan view showing the provision of twist lock castings which are provided at each corner of the main frame.
Figure 20:
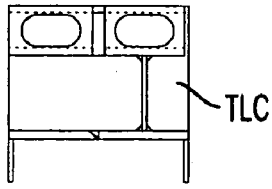
FIG. 20 is a plan view showing the provision of twist lock castings on the cross member which interconnects the upper ends of the pillars.
Figure 27:
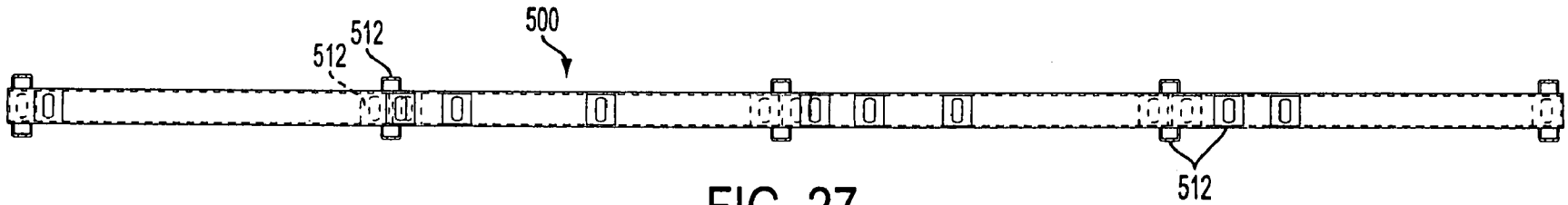
FIGS. 27 and 28 are respectively plan and side views of a connection beam which can be used with the embodiments of the transport platform according to the invention.
Figure 28:
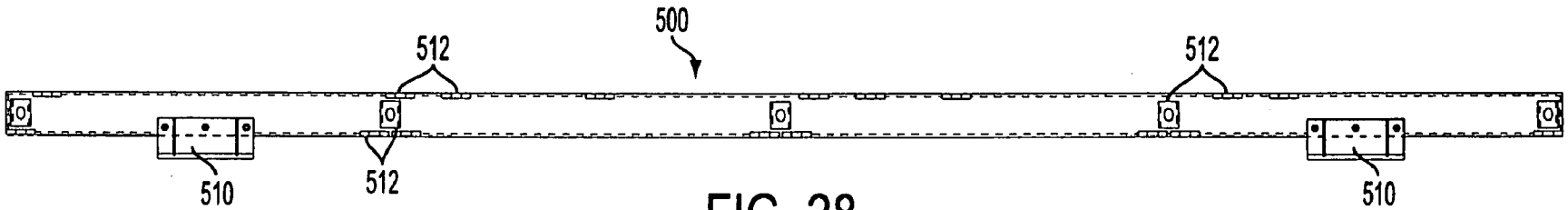
Figure 29:
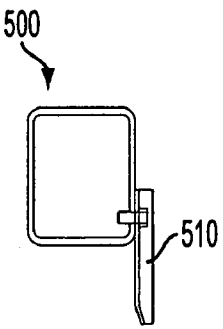
FIG. 29 is a sectional view of the connection beam shown in FIGS. 27 and 28, showing the tubular nature of the beam and the manner in which side skirts are removably bolted thereto.

FIGS. 19 and 20 show the provision of twist lock castings TLC which are provided on the end members 402 and upper cross members 412. These castings TLC allow for connection rails such connection rails 200 shown in FIGS. 1 and 2, or connection rails 500 which are shown in FIGS. 27–29. The connection rails 200 can have a hollow tubular construction similar to connection rails 500 or alternatively have an I-beam base similar to the beams used in the arrangements disclosed in U.S. Pat. No. 6,027,291 issued on Feb. 22, 2000 in the name of Sain et al. The disclosure of this reference, to the degree that it is pertinent to the claimed subject matter, is hereby incorporated by reference thereto.

Figure 24:
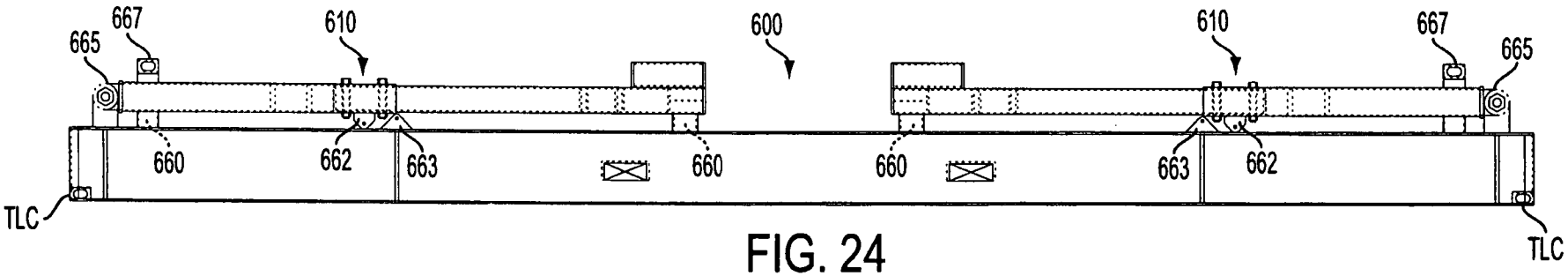
FIG. 24 is a side view of a third embodiment showing pillars which are arranged to be folded flat on the upper surface of the deck.
Figure 26:
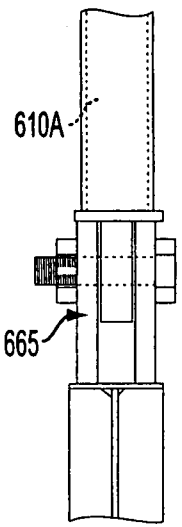
FIG. 26 is an end view of the arrangement shown in FIG. 25.
Figure 25:
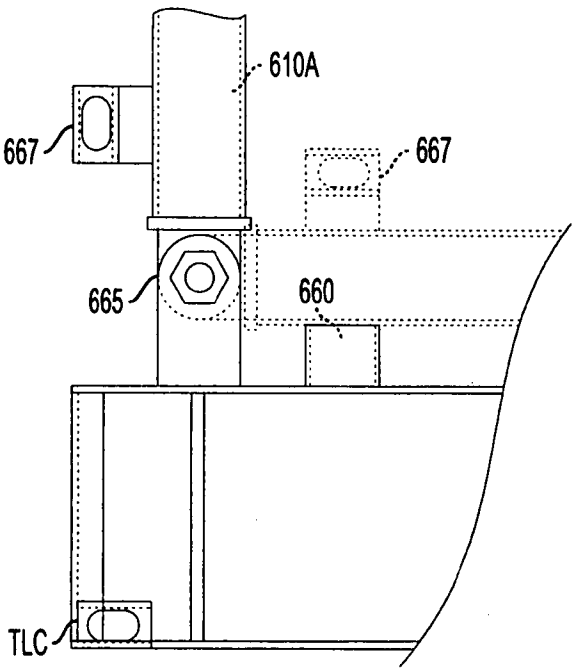
FIG. 25 is an enlarged side view of the hinge portion of the folding pillars an upright position.

FIGS. 24–26 show a third embodiment of the invention. In this third embodiment 600, the masts 610 are arranged to be pivotal at a location near the base so as to allow them to fold down onto the deck of the platform in the manner shown in FIG. 24. Support blocks 660 are provided on the deck to engage the mast when it is in a folded position and extends essentially parallel to the top of the deck. Further, the deck and mast are provided with projections 662, 663 which in this embodiment are essentially triangular in shape. The projections 662, 663 are use to connect the ends of an angled braces (not shown in this figure) such as braces 413 shown in FIG. 10. As will be appreciated, the angle braces 413 in FIG. 10 extend between similar projections 462, 463 and establish a reinforcing triangulation. In the third embodiment, these angle braces assume a higher degree of importance in that the pivotal base arrangement of the masts requires the braces in order to maintain the upright position of the masts during use.

These projections 662, 663 can also be used as connection sites for tie-down cables/chains if so required.

The hinges 665 in this third embodiment are constructed so that the pivot shaft is a bolt which can be removed to allow the mast be disconnected/replaced or the like.

As shown in FIG. 19, further outwardly extending projections 667 are provided on the masts. These projections 667 are slotted and are arranged so that the slots align with one of the slots in the end member. Alternatively, this projection can take the form of a cross-member which interconnects the lower ends of the masts and thus adds rigidity to the structure. This member, if provided, is formed with a plurality of slots which correspond to and are aligned with those formed in the end of the platform.

FIGS. 27 to 29 show an embodiment of the above mentioned connection rail arrangement. The embodiment of the connection rails 500 shown in FIGS. 27–29 are such as to have a hollow cross-section as seen from the end view shown in FIG. 29 and are provided with detachable skirts 510 which are bolted in position on the sides of the rails. The rails are each provided with a plurality of twist lock castings/apertures 512 which enable connection of the rails with containers and transport platforms according the embodiments of the invention.

For further disclosure relating to the structures which are ancillary to that disclosed hereinabove, the content of U.S. Pat. No. 6,533,510 is hereby incorporated by reference. This patent which was issued on Mar. 18, 2003 in the name of Sain, and discloses use of stacking/interconnecting arrangements which facilitate side-by-side stacking of containers.

Twist lock devices are well known in the art to which this invention is applicable. For further disclosure relating to these devices reference may be had to U.S. Pat. No. 6,460,227 issued in the name of Hove on Oct. 8, 2002, or U.S. Pat. No. 6,390,743 issued to Metternich on May 21, 2002. The content of these patents is also hereby incorporated by reference.

While the invention has been disclosed with reference to a limited number of embodiments, the various modifications and variations which can be made without departing from the scope of the invention, which is limited only by the appended claims, will be self-evident to those skilled in the art of container construction and shipping.

What is claimed is:

1. A transport platform comprising:

a platform; and adjustable length pillars provided either side and at both ends of the platform, the adjustable length pillars each having an upper cross-member interconnecting the upper ends thereof, wherein the platform is provided with cross-members which are connected with the platform and which extend parallel with the upper cross-members, wherein the upper and lower cross-members are provided with openings by which the upper and lower cross-members are engageable with structural members adapted to hold the platform in a predetermined position during transit, and wherein the structural members comprise vertically extending guide members which are fixed to container ship bulkheads.

2. A transport platform as set forth in claim 1, wherein the openings in the upper and lower cross members comprise spaced vertically extending slots which are adapted to engage the vertically extending guide members.

3. A transport platform as set forth in claim 1, wherein the structural members comprise connection rails used to connect the transport platform to one or more adjacent containers, and the connection rails engage the containers in a side-by-side configuration.

4. A transport platform as set forth in claim 1, wherein the structural members comprise connection rails used to connect the transport platform to one or more adjacent containers, and the upper and lower cross-members are provided with apertures which are so sized and located as allow releasable interconnection with the connection rails.

5. A transport platform as set forth in claim 1, wherein the platform is flat and adapted to have vehicles and other cargo including boats, buses etc., which are not suited for disposition in conventional containers, secured thereon.

6. A transport platform as set forth in claim 1, wherein the adjustable length pillars each comprise a base member rigidly connected with the platform and a telescopic member which is slidably disposed with the base member.

7. A transport platform as set forth in claim 6, wherein the upper cross-members interconnect upper ends of a pair of telescopic members.

8. A transport platform as set forth in claim 6, wherein the adjustable length pillars each further comprise a locking device which selectively locks the telescopic member in one of a plurality of positions relative to the base member.

9. A transport platform as set forth in claim 8, wherein each locking device comprises a locking pin which is disposed through apertures which are formed in the telescopic member and the base member of the adjustable length pillars.

10. A transport platform as set forth in claim 1, further comprising a cargo connection device which is provided on the platform and adapted to facilitate connection of cargo to the platform.

11. A transport platform as set forth in 10, wherein the cargo connection device is movable and selectively positionable on the platform.

12. A transport platform comprising:

a platform; and adjustable length pillars provided either side and at both ends of the platform, the adjustable length pillars each having an upper cross-member interconnecting the upper ends thereof, wherein the platform is provided with cross-members which are connected with the platform and which extend parallel with the upper cross-members, wherein the upper and lower cross-members are provided with openings by which the upper and lower cross-members are engageable with structural members adapted to hold the platform in a predetermined position during transit, wherein the structural members comprise connection rails used to connect the transport platform to one or more adjacent containers, and wherein the openings in the upper and lower cross members comprise openings formed in twist lock castings which are connected with the upper and lower cross members to allow for twist lock devices to interconnect the upper and lower cross members with the connection rails.

13. A transport platform comprising:

a platform; and adjustable length pillars provided either side and at both ends of the platform, the adjustable length pillars each having an upper cross-member interconnecting the upper ends thereof, wherein the platform is provided with cross-members which are connected with the platform and which extend parallel with the upper cross-members, wherein the upper and lower cross-members are provided with openings by which the upper and lower cross-members are engageable with structural members adapted to hold the platform in a predetermined position during transit, and wherein the upper and lower cross members are adjustably connected to a frame of the platform so as to be laterally adjustable within a predetermined limit with respect to the frame of the platform.

14. A transport platform arrangement comprising:

a transport platform comprising:

a platform; and pillars provided on either side and at both ends of the platform, the adjustable length pillars each having an upper cross-member interconnecting the upper ends thereof, wherein the transport platform arrangement further comprises first connection rails which are disposed over and connectable to the upper cross-members, the first connection rails being connectable to at least one container which is disposed adjacent the transport platform, and wherein the platform further comprises lower cross-members fixed thereto, the lower cross-members being parallel to the upper cross-members, and wherein the transport platform further comprises first connection devices which interconnect the first connection rails to the upper cross-members and to an upper side of the at least one adjacent container.

15. A transport platform arrangement as set forth in claim 14, further comprising second connection rails which are disposed under the lower cross-members and interconnected thereto by second connection devices which connect the second connection rails to lower sides of the at least one adjacent container.

16. A transport platform arrangement as set forth in claim 14, wherein the first and second connection devices comprise twist lock devices.

17. A transport platform comprising:

a platform having first and second end members in which spaced vertically extending first slots are formed, the first slots being adapted to receive one of a plurality of vertically extending guide members that are provided on bulkheads of a container ship hold;

first and second sets of vertically extending pillars which are respectively provided at first and second ends of the platform; and first and second cross members respectively interconnecting the upper ends of the first and second sets of pillars, the first and second cross members each having spaced vertically extending second slots that are aligned with the vertically extending first slots and which are adapted to receive the vertically extending guide members which are formed on the bulkheads of the container ship hold.

18. A transport platform as set forth in claim 17, wherein the first and second end members and the first and second cross members are adjustably connected to the platform so as to allow a position of the first and second end members and the first and second cross members to be laterally adjustable with respect to the platform.

19. A transport platform as set forth in claim 17, wherein the platform is wider than a distance between adjacent said vertically extending guide members.

20. A transport platform as set forth in claim 17, wherein the first and second slots are respectively spaced in a predetermined relationship with a width of the platform and a distance between the vertically extending guide members which are disposed on the bulkheads.

21. A transport platform as set forth in claim 17, wherein the first and second slots are spaced so that a number of said platforms can be disposed side-by-side across the bulkhead of the container ship hold in manner wherein the number of spaces between the guide members is different from the number of said platforms.

22. A transport platform as set forth in claim 17, wherein the pillars are telescopic and selectively adjustable in length.

23. A transport platform as set forth in claim 17, wherein the pillars comprise upper and lower halves, wherein the upper halves are slidable in the corresponding lower halves, and wherein locking arrangements are provided with each of the pillars for selectively locking the upper half in selected positions relative to the lower half.

24. A transport platform as set forth in claim 17, wherein the pillars are each pivotally supported on the platform in a manner which allows each pillar to be pivoted to a position wherein each pillar is essentially parallel to a deck of the platform.

25. A transport platform as set forth in claim 17, wherein the pillars are provided with pillar projections which extend toward the ends of the platforms and which have slots formed therein, the slots in the pillar projections having essentially the same width and depth as the slots in the end member and which are aligned with one of the slots in the end members.

26. A transport platform as set forth in claim 17, further comprising brace members which interconnect portions of the pillars with a portion of the platform.

27. A transport platform as set forth in claim 17, wherein the first and second end members and the first and second cross members each have an apertured casting at each end, and wherein the castings are adapted to receive connection members and to enable the first and second end members and the first and second cross members to be detachably connected to elongate connection rails which are used to interconnect the transport platform with an adjacent structure.

28. A transport platform as set forth in claim 27, wherein the connection members comprise twist lock devices.

29. A transport platform as set forth in claim 17, further comprising a deck which is disposed on an upper side of the platform to support cargo which is disposed therein.

30. A method of disposing transport platforms below deck in a hold of a container ship wherein the fore and aft bulkheads of the hold are provided with vertically extending guide members, comprising:

selectively disposing the transport platforms in the hold so that one of the vertically extending guide members is slidably engaged in one of a plurality of spaced vertically extending first slots formed in an end member provided at each end of the platform, to prevent movement of the platform relative to the hold of the container ship.

31. A method as set forth in claim 30, further comprising:

holding the platforms in predetermined positions within the hold using a plurality of spaced vertically extending second slots wherein the vertically extending second slots are formed in a cross member which interconnects the upper ends of pillars that extend up from the platform proximate the ends of the platform, and wherein the vertically extending second slots are respectively aligned with the vertically extending first slots formed in the end members at each end of the platform.

32. A method as set forth in claim 31, further comprising:

interconnecting the transport platforms which are one of a) disposed side-by-side and b) disposed beside a container, using elongate connection rails which are disposed over the cross members of the platforms; and interconnecting the cross members with the elongate connection rails using twist lock devices.

33. A method of disposing transport platforms in a hold of a container ship wherein the hold has fore and aft bulkheads which are each provided with a plurality of spaced vertically extending guide members between which cell guides are defined, comprising:

providing spaced vertically extending slots in each end of each transport platform wherein the plurality of spaced vertically extending slots are spaced in accordance with a predetermined relationship between a width of each transport platform and a distance between the spaced vertically extending guide members which define the cell guides, and wherein each slot is dimensioned to receive one said guide member therein; and disposing the platforms in the hold in a side-by-side relationship so that a number of the platforms and a number of the cell guides which are occupied by the platforms are different.

34. A method as set forth in claim 33, further comprising adjustably connecting end members in which the vertically extending slots are formed to the transport platform and allowing the end members to be laterally adjustable with respect to the platform.

35. A method as set forth in claim 34, further comprising:

providing telescopic masts on the platform;

interconnecting the upper ends of the masts with upper cross members that each have portions in which vertically extending slots, which correspond to the vertically extending slots formed in the end members, are formed; and connecting the portions of the upper cross members in which the vertically extending slots are formed so as to be adjustable with respect to the remainder of the upper cross members so that the portions of the upper cross members in which the vertically extending slots are formed are laterally adjustable with respect to the remainder of the upper cross members.

* * * * *